United States Patent [19]

Varner

[11] Patent Number: 5,055,082

[45] Date of Patent: Oct. 8, 1991

[54] CONVERTIBLE TOY

[75] Inventor: Steven R. Varner, Torrance, Calif.

[73] Assignee: Varner Incorporated, Gardena, Calif.

[21] Appl. No.: 580,660

[22] Filed: Sep. 10, 1990

[51] Int. Cl.[5] ..... A63H 13/10

[52] U.S. Cl. ..... 446/308; 446/310; 446/288; 446/487

[58] Field of Search ..... 446/288, 289, 279, 283, 446/290, 291, 292, 269, 308, 309, 310, 311, 312, 487, 476

[56] References Cited

U.S. PATENT DOCUMENTS 1,530,213 3/1925 Squire ..... 446/288
4,453,340 6/1984 Kozuka ..... 446/288
4,454,679 6/1984 Ogawa ..... 446/289
4,540,379 9/1985 Tachibana ..... 446/289

*Primary Examiner*—Robert A. Hafer
*Assistant Examiner*—David J. Kenealy
*Attorney, Agent, or Firm*—John A. Sarjeant

[57] ABSTRACT

A convertible toy in which a device of one appearance can be change to a substantially different appearance. For example, from an apparently innocuous-looking device, such as a computer or a trash can, a figurine can be rotated up through a space left by a receding part in the top so that the figurine may appear to visually observe the surroundings.

5 Claims, 2 Drawing Sheets

CONVERTIBLE TOY

TECHNICAL FIELD

This invention relates to toys which have convertible appearances. More specifically, it involves devices that may be changed from one form to another, for example, from a device resembling a computer exterior to one in which a figurine pops out of the top surface of the computer exterior.

BACKGROUND ART

Various patents have been granted on toy devices that are convertible in one way or another. U.S. Pat. No. 4,575,348 depicts a case that can be open to allow a popup figure to be displayed. The figure is carried on a table journalled in a tray for rotation about an axis parallel to the base of the device. As the tray advances to the opposite end of its travel, it passes over a fence that cooperates with a formation on the lower face of the table to erect the figure.

U.S. Pat. No. 4,581,904 illustrate a toy locket which contains parts that can be manually rotated out when the locket is opened. These parts may simulate parts such as the head and extremities of a living thing. Because of grooves in the periphery of the locket, it may be closed with these parts in the exposed position, and, in this way, the locket may be used as the body of the living thing.

U.S. Pat. No. 4,606,618 is one of a number of patents in which a device of one design can be converted to a device of a different design by manually rotating various parts. For instance, in this patent, a pair of binoculars can be changed into a toy robot.

The inventor herein has been involved with others in creating a device in which a figurine seems to be piloting a boat. When the figurine is pressed forward and downward it ends up face down in the boat while a different figurine is rotated out of the bottom of the device and ends up sitting in a different configuration, such as a telephone which is apparent once the device is turned over. In this device, a flap is rotated with each figurine to fill in the area immediately forward of the figurine when it is in the sitting position. However, when the figurine is depressed, its back and the interior of its container are open to the elements.

DISCLOSURE OF INVENTION

The present invention is directed to a mechanism which when used in any visual three dimensional device will give the appearance of converting that device to a different embodiment. The device has a trap door in the top. The door is hinged close to one end, so that when the short side of the door is depressed, the door flips up. On the inside of the door is the upper portion of a figurine which assumes a sitting position in the container when the top is opened. A flap is attached to the figurine in such a way that it pivots with the figurine and substantially fills in the gap which would otherwise be left in front of the figurine. In a preferred arrangement, the open door fills in the gap that would appear behind the figurine. When the door is closed, the figurine and the flap collapse on the hinge and are hidden inside the device.

The device may be provided with wheels or ball bearings, which, in turn, may be retracted or extended with the closing or opening of the door. In this way, an innocuous design can be converted into a mobile device which contains an undercover agent.

BEST MODES FOR CARRYING OUT THE INVENTION

The invention will now be explained in detail with reference to the FIGS. Throughout the description the same number will be used for the same element.

Figure 1:
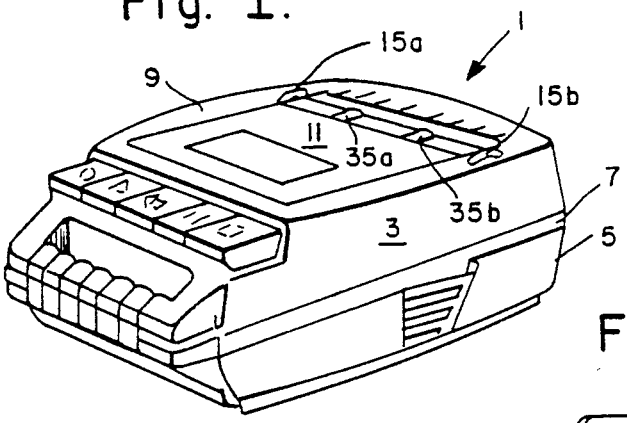
FIG. 1 is a perspective view of a closed embodiment of the present invention.

Referring to FIG. 1, container 1 is shown in a perspective view, in this instance resembling one form of computer. In this embodiment, container 1 consists of an upper part 3 and a lower part 5, which may be separated at seam 7. Upper part 3 has top 9, which, in turn, has door 11. Door 11 is pivoted on pin 13 (not shown in FIG. 1 but see FIGS. 4 and 8); door 11 may be pivoted manually or by springs (not shown). Pin 13 is held in placed by having pin ends inserted into retaining cups 15*a* and 15*b*.

Figure 2:
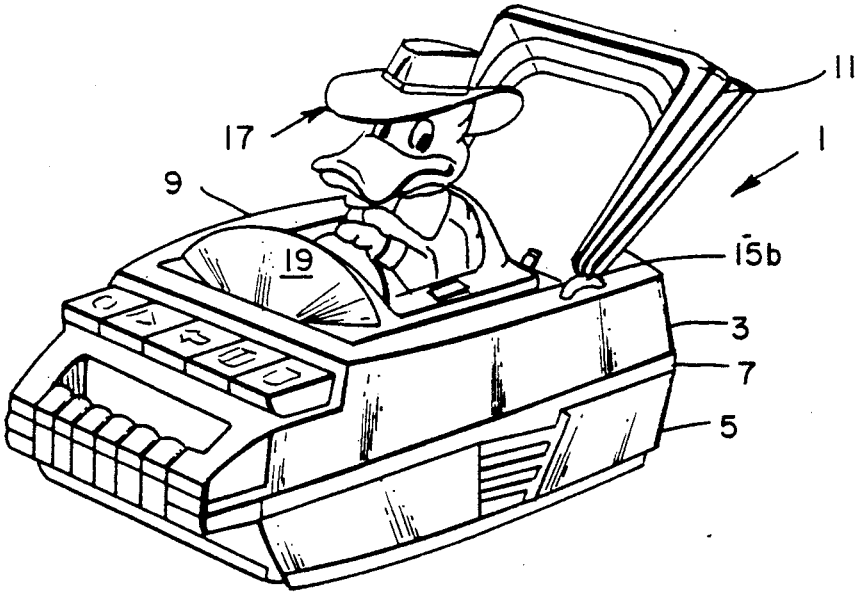
FIG. 2 is a perspective view of an open embodiment of the present invention.

FIG. 2 is a perspective view from slightly above and to the right of the invention. In this view, door 11 is open and figurine 17 appears to be seated in a driving position wih windshield 19 in front of him.

Figure 3:
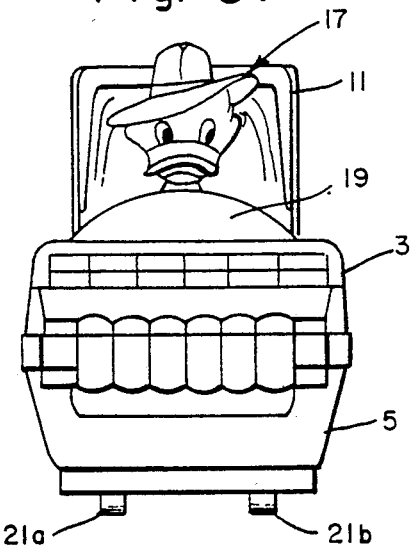
FIG. 3 is a front view of the FIG. 2 embodiment.

FIG. 3 is a front view of the same embodiment as FIG. 1, but, in this case, door 11 is open to the rear and partial figurine 17 has emerged through top 9 and appears to be in a driver'seat (not shown). Windshield 19 has also emerged and is located in the front of the opening created by the opening of door 11. Wheels 21*a* and 21*b* (optional) have emerged from the bottom of lower part 5. Depending on the representation of container 1, additional wheels may be added for appearence or stability.

Figure 4:
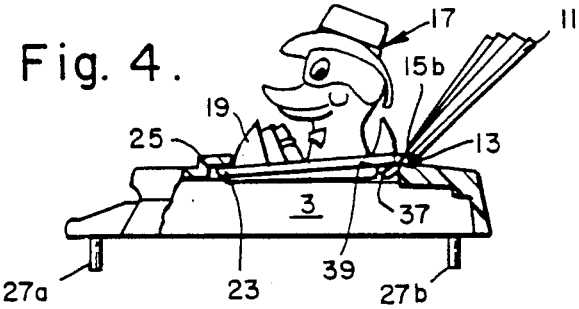
FIG. 4 is a side view of the top part of the invention with the door open and the figurine in the driver's position.

FIG. 4 is a side view of upper part 3. In this view, one end of pin 13 is shown flush with the outer face of retaining cup 15*b*. Lip 25 is a forward part of top 9 and is designed to catch the forward edge of seat 23 as it swings up when door 11 is opened. Alignment pins 27*a* and 27*b* are designed to facilitate the correct assembly of upper part 3 and lower part 5 by fitting in holes 29*a* and 29*b*, as seen in FIG. 5.

Figure 5:
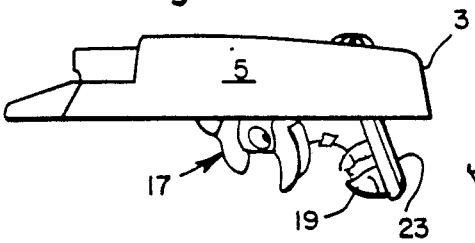
FIG. 5 is a side view of the top part of the invention with the door in the closed position.

FIG. 5 is a side view of upper part 3 when door 11 is in the closed position. Figurine partially protrudes from the bottom of upper part 3, and its position relative to seat 23 is apparent.

Figure 6:
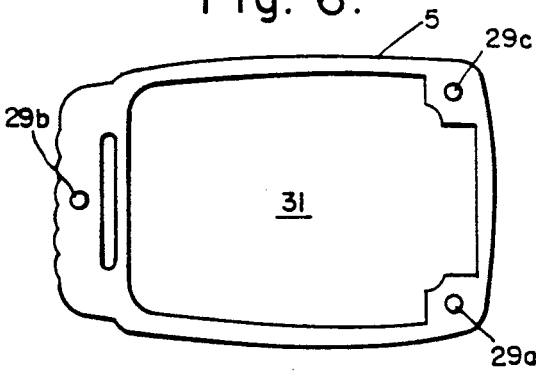
FIG. 6 is a top view of the lower part of the invention.

FIG. 6 is a top view of lower part 5. Holes 29*a*, 29*b*, and 29*c* are receptacles for alignment pins 27 when upper part 3 and lower part 5 are mated. Void 31 provides space for figurine 17 and seat 23 when door 11 is closed.

Figure 7:
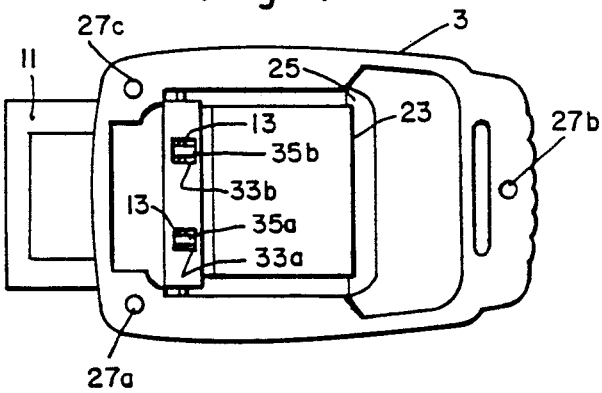
FIG. 7 is a top view of the top part of the invention in an upside down position, showing the relation of the pivot pole, the figurine and the door.

FIG. 7 is a view of upper part 3 in an upside down position, and, with FIG. 6, it forms a butterfly arrangement. In this view, door 11 is closed. The rear area of door 11 is in cross-section to show in openings 33*a* and 33*b* pin 13 in sections traversing the rear end of door 11. Centered in openings 33*a* and 33*b* are lugs 35*a* and 35*b* which form the rear section of door 11. Lugs 23*a* and 23*b* have openings (not shown) which allow them swing on pin 13 when door 11 is opened.

Figure 8:
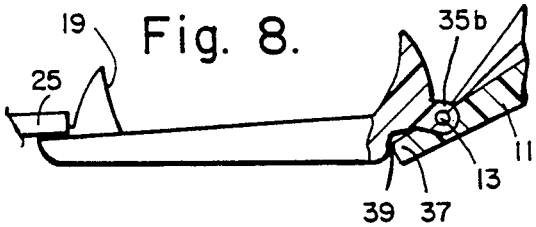
FIG. 8 is a side elevational, cross-sectional view, showing the relationship of the door (a portion only), the hinge pin, and the driver's seat including a forward projecting flap

FIG. 8 illustrates in cross-section, the relationship of door 11, pin 13, and seat 23 in the open position. As door 11 swings to the rear on pin 13, end 37 of the door engaged seat 23 along contact area 39 and forces the seat up into the opening created when the door opens until forward end of seat 23 is stopped by lip 25. When door 11 is closed, end 37 swings up behind pin 13 and fills in the space between pin 13 and the permanent part of top 9.

The devices of this invention can be made from many materials. For instance, they made be molded from polyethylene or high impact polystyrene. The figurine is preferably made from polyvinyl material. In addition, the top part and bottom part may be sealed together or even formed together.

While the invention has been illustrated by one embodiment, it will be apparent that many variations may be made without departing from the inventive concept set forth in the following claims.

I claim:

1. A toy comprising a container having a door on its upper surface and a flap with attached figurine under the door, said door and said flap being separately hinged on a pin traversing an opening created when the door is opened, said door being hinged off-center so that there is a short section and a long section of said door and, by depressing the short section, the door opens upwardly and to the rear so that the short section of the door engages the flap and forces it, with attached figurine, up into the opening left by the door in the upper surface.

2. A toy according to claim 1 wherein said toy resembles a convertible automobile.

3. A toy according to claim 1, said toy having wheels.

4. A toy according to claim 3, wherein the wheels are retracted and hidden when the door is closed and extended and visible when the door is opened.

5. A toy according to claim 1 wherein the flap is a seat for the figurine.

* * * * *